United States Patent [19]

Crooks

[11] 4,187,329

[45] Feb. 5, 1980

[54] ELECTROPHOTOGRAPHIC DEVELOPING PROCESS AND COMPOSITIONS FOR USE THEREIN

[75] Inventor: Walter Crooks, Los Gatos, Calif.

[73] Assignee: International Business Machines Corporation, Armonk, N.Y.

[21] Appl. No.: 112,393

[22] Filed: Feb. 3, 1971

Related U.S. Application Data

[63] Continuation-in-part of Ser. No. 809,966, Mar. 24, 1969, abandoned.

[51] Int. Cl.[2] ..... G03G 13/08; G03G 9/08

[52] U.S. Cl. ..... 430/110; 427/195; 430/111; 430/120

[58] Field of Search ..... 117/17.5; 96/1 R, 1 SD; 252/62.1; 118/637; 427/14, 18, 19, 20, 21, 195

[56] References Cited

U.S. PATENT DOCUMENTS

| | | | |
|---|---|---|---|
| 2,611,153 | 9/1952 | Semegen | 260/900 |
| 2,618,551 | 11/1952 | Walkup | 252/62.1 |
| 2,638,416 | 5/1953 | Walkup et al. | 117/17.5 |
| 2,788,288 | 4/1957 | Rheinfrank et al. | 252/62.1 |
| 2,940,934 | 6/1960 | Carlson | 252/62.1 |
| 2,985,918 | 5/1961 | Moore et al. | 260/900 |
| 3,030,260 | 4/1962 | Metzler et al. | 260/900 |
| 3,079,342 | 2/1963 | Insalaco | 252/62.1 |
| 3,153,681 | 8/1964 | Anderson et al. | 260/897 |
| 3,262,806 | 7/1966 | Gourge | 117/17.5 |
| 3,280,036 | 10/1966 | Howell | 117/17.5 |
| 3,349,703 | 10/1967 | Varron et al. | 117/17.5 |
| 3,392,139 | 7/1968 | Dingman | 117/17.5 |

*Primary Examiner*—Michael F. Esposito
*Assistant Examiner*—Stuart D. Frenkel
*Attorney, Agent, or Firm*—Joseph G. Walsh

[57] ABSTRACT

Wetting by toners of the surface of reusable photoconductors in electrophotographic processes results on image cycling in adhesion of the toner to the photoconductor surface to form a film. Such filming is reduced or eliminated by including in the developer a small amount of certain unpigmented organic polymeric materials having smaller particle size than the pigmented toner particles. Suitable organic polymers are fluorinated hydrocarbon polymers and copolymers, and polyethylene.

15 Claims, No Drawings

ELECTROPHOTOGRAPHIC DEVELOPING PROCESS AND COMPOSITIONS FOR USE THEREIN

The present application is a continuation-in-part of application Ser. No. 809,966 filed Mar. 24, 1969, and now abandoned.

FIELD OF THE INVENTION

This invention pertains to an improved electrophotographic process. By the addition of certain unpigmented polymers to the toner, filming of the photoconductive surface during the development process is decreased.

PRIOR ART

The use of an additive in the developer has been disclosed in the prior art. The addition of hydrophobic metal salts of fatty acids is disclosed in Dutch Patent Application No. 6617058 of Frank L. Palermiti.

U.S. Pat. Nos. 2,940,934 and 3,079,342 each show electrophotographic toners which contain polyethylene. In each case in the prior art the polyethylene is an integral part of the pigmented toner particles. In the present invention, however, the fluorinated polymer or polyethylene is present as separate, unpigmented particles having a smaller size than the pigmented toner particles.

BACKGROUND OF THE INVENTION

Electrophotography, because of its simplicity, has during the last decade found rapid acceptance in the office copying and reproduction fields. The first electrophotographic process in its basic form is described by Chester F. Carlson in U.S. Pat. No. 2,297,691. Since Carlson's discovery, many other reproduction processes based on the use of photoconductive materials have followed. Such methods have in common the use of toners, and if the photoconductive surface is to be reusable, it must be kept clean of toner accumulation. The present invention solves this problem.

In the type of electrophotography known as xerography, the essential element is the reusable electrophotoconductive insulating layer. A latent electrostatic image is formed by first charging and then exposing the electrophotoconductive insulating surface to a light pattern. The image is then developed with a thermoplastic electroscopic material, known as toner, and this material is transferred to and then fixed to paper.

The methods employed to develop images in electrophotographic printing processes are many and varied. They include cascade development as described in U.S. Pat. No. 2,618,552, powder cloud development as described in U.S. Pat. No. 2,221,776, magnetic brush development as described in U.S. Pat. No. 2,874,063 and other methods including fur brush development, donor belt development, impression development and liquid spray development. The two methods most frequently employed in commercial office copying machines which make use of reusable electrophotographic insulators are the cascade mode of development and magnetic brush development. The toner particles applied in these development processes consist of one or more thermoplastic resin binder materials. The most frequently employed thermoplastic resin binder is a copolymer of styrene and butyl methacrylate, of the type shown, for instance, in U.S. Pat. No. 2,940,934. Other thermoplastic resin binders are also used, either alone or in mixtures, for example, polystyrene, polymethyl styrene, polylethyl methacrylate, polybutyl methacrylate, polyvinyl butyral, coumarone-indene resins, copolymers of n- and p-vinyltoluene and butadiene, thermoplastic polyamide resin, epoxy resins, rosin, rosin esters, and the like. The binder is mixed with about 8% of a coloring pigment, for example, carbon black, iron or a dye such as nigrosine, so that a colored image can be easily heat fused onto a copy sheet.

The transfer of the toner to the paper is by electrical attraction. Electrical transfer is accomplished by placing the paper in contact with the imaged area of the plate, charging the paper electrically with the same polarity as that of the latent image, and then stripping the paper from the plate. The charge applied to the paper overcomes the attraction of the latent image for the toner particles and pulls them onto the paper. Another technique for electrostatic transfer utilize a semiconductive roll. A dc potential of the correct sign and voltage is applied between the roll and the electrode of the reusable electrophotoconductive insulating layer.

Complete transfer of toner from the surface of the reusable photoconductive insulating layer to the paper is not accomplished by these transfer methods. Accordingly, a fraction of the toner remains behind on the surface of the reusable electrophotoconductive insulating layer, and this residual toner must be removed prior to the next cycle. In automatic machines cleaning of the residual toner is usually accomplished by a rotating fur brush combined with a vacuum suction. The fur can be natural such as rabbits fur, or synthetic such as nylon, or Dynel, which is a copolymer of vinyl chloride and acrylonitrile. Another method for cleaning residual toner from the surface of the reusable electrophotoconductive layer is web cleaning.

These methods of cleaning are efficient in that they remove all but a small fraction of the residual toner. The frictional forces generated during the cleaning, however, promote the wetting of the surface of the photoconductive insulating layer by the thermoplastic resins of this small fraction of toner and this in turn results in a formation of a film of toner on the surface of the reusable layer. During recycling toner-filming continues and eventually a layer of pigment and thermoplastic resin of such dimensions is present on the surface of the reusable element that copy quality is seriously impaired. This deleterious effect occurs after several hundred or several thousand cycles.

After copy quality is impaired, it becomes necessary to clean or replace the electrophotoconductive insulating surface. This is inconvenient and expensive in time and material, and the solution of this problem is an object of the present invention.

SUMMARY OF THE INVENTION

A method has now been discovered for preventing the thermoplastic resins of toner materials from forming films on the surface of the reusable electrophotoconductive insulating layer elements. Furthermore, this method facilitates removal of toner from the cleaning brush, thus preventing redeposition of toner on the surface of the photoconductive insulating layer.

In accordance with the present invention, a method is provided which greatly extends the life of the reusable photoconductive element and maintains the quality of its imaging characteristics. The method comprises carrying out the development process with a toner that contains a small percentage of pigment-free small particle size additive selected from the group consisting of polytetrafluoroethylene, polyvinylfluoride, polyvinylidenefluoride, polyethylene, polyhexafluoropropylene, copolymers of tetrafluoroethylene with tetrafluoropropylene, and copolymers of tetrafluoroethylene with hexafluoropropylene.

The amount of polymer additive is preferably less than 10% by weight of the amount of toner. When the amount of additive is greater than 10%, there is a tendency for undesirable films of additive to build up and image definition is thereby adversely affected. In general, it is preferred that the amount of additive be from about 5% to about 0.25% by weight of the amount of toner. Other parameters determine the optimum in each case. The optimum amount of additive varies, for example, with the particular type of cleaning method used.

It has now been shown that filming of toner can be reduced by at least an order of magnitude in terms of cycles, by inclusion of small amounts of pigment-free small particle size organic polymers of the specified type in the toner-carrier developer mix. The particle size of at least part of the additive organic polymers must be less than the average particle size of the toner. Most toners have an average particle size in the 5–20μ range. The most efficient additive polymers which have been used so far have an average particle size in the 0.5–1.0μ range.

PREFERRED EMBODIMENTS

The general nature of the invention having been set forth, the following examples are now presented as to the specific operation of the invention. The specific details presented are for purposes of illustration and not limitation. Parts and percentages are by weight unless otherwise indicated.

EXAMPLE I

In this experiment, TL-120 (a 0.7 micron average particle size hexafluoropropylene-tetrafluoroethylene copolymer manufactured by Liquid Nitrogen Processing Corporation) was added to Hunt Graph-O-Print toner at a 0.1% level of addition on a weight basis. (Hunt Graph-O-Print toner is a pigmented polystyrene-N-butyl methacrylate copolymer manufactured and commercially available from Philip A. Hunt Chemical Co.). After mixing, the toner and additives are cycled with an organic photoconductive insulating film containing 8% by weight of a polyester adhesive available commercially from duPont and known as 49000 Mylar adhesive. This adhesive is a 60/40 ethylene terephthalate/isophthalate copolymer. The organic electrophotoconductive insulating film comprises a one-to-one molar ratio of polymerized vinylcarbazole and 2,4,7-trinitro-9-fluorenone disclosed and claimed in U.S. Pat. No. 3,484,237. The cycling was carried out on a laboratory toner-cycling machine which, to a degree, simulates copying machine cleaning conditions. The toner and additive mixture is continually rubbed against the organic electrophotoconductive insulating film with rabbit's fur, a material used in the cleaning brushes for electrophotoconductive insulating films. After 10,000 cycles the film was examined with a microscope to determine the degree of filming which had occurred. It was next compared with two controls, one of which had been cycled for the same number of cycles with toner without the small particle size organic polymeric additive and rabbits fur and the other for the same number of cycles with rabbits fur alone. The system showed no filming and compared equally with rabbits fur alone. The other control was filmed to the degree normally associated with this system.

EXAMPLE II

Example I was repeated, with the additive TL-120 replaced by ½% FX-161, a fluorocarbon manufactured by Minnesota Mining and Manufacturing Company. All other conditions and operations were as in Example I. In this case the test system was only slightly filmed in comparison to the control without FX-161.

EXAMPLE III

In this experiment, Example I was repeated, using as the additive 1% Microthene 500, a polyethylene powder which has an average particle size in the 8–30μ range. Microthene 500 is manufactured by U.S. Chemicals. In this case the test system was only slightly filmed in comparison to the control without Microthene 500.

EXAMPLE IV

Example I was repeated, but in this experiment the additive was 5% TL-115, a polytetrafluoroethylene of average particle size in a 8–10μ range. TL-115 is manufactured by Liquid Nitrogen Processing Corp. The critical surface tension of polytetrafluoroethylene is of the order 18 dynes/cm at 20° C. In this case the test system showed no filming and compared equally with rabbits fur alone. The other control, which was toner without TL-115, was filmed to the degree normally associated with this system.

EXAMPLE V

Example I was repeated, but in this experiment the additive was 5% TL-126, a polytetrafluoroethylene of 8–10μ average particle size. TL-126 is manufactured by Liquid Nitrogen Processing Corp. The results from this experiment were the same as for Example IV.

EXAMPLE VI

This experiment was a repeat of Example I except ½% TL-120 was added to IBM toner JM-245, which contains maleic rosin and styrene butyl methacrylate thermoplastic resins. The results from this experiment were the same as for Example I

EXAMPLE VII

This experiment was performed on a drum robot copying machine which simulates exactly the cycling conditions of a xerographic copying machine. In one cycle the organic electrophotoconductive insulator, which is the same as that described in Example I, is charged, exposed, cascade developed, corona transferred, corona precleaned and cleaned, all at 4"/sec. The developer mix contained 2% Hunt Graph-O-Print toner of which 1 part in 99 parts was TL-120, and 98% Exon-Orasol red coated glass beads. A Dynel brush was used in the cleaning station and engagement and speed of rotation were set at optimum conditions for a developer mix containing no organic filming-inhibitor. The degree of filming is measured as a function of loss of gloss of the surface of the reusable element. It was found that the average initial gloss reading was 146 and after 10,000 cycles was 144 as measured on a Photovolt-Gloss-Meter. Without the presence of the TL-120, the initial gloss was 145 and was 116 after only 5000 cycles. In the former case, print quality was excellent and no toner filming was evident. In the latter case, the surface of the organic electrophotoconductive insulator was visibly heavily filmed with toner. Print quality was adversely affected.

EXAMPLE VIII

This was a repeat of Example VII but the organic electrophotoconductive insulator was replaced with selenium, which is an inorganic electrophotoconductive insulator. The carrier in the developer mix was changed and yellow sand was used instead of the Exon-Orasol red coated glass beads. This is a positive carrier and necessary to impart a negative triboelectric charge on the Hunt Graph-O-Print toner. Since selenium is a "p" type photoconductor, it is more efficient in a positively charged mode. Cycling was continued for 2000 cycles only and then the experiment was stopped since the test was progressing in the same manner as the test described in Example VII.

EXAMPLES IX–XXIX

The procedure of Example I may be repeated using other commercially available toners in place of Hunt Graph-O-Print. Commercially available toners all comprising thermoplastic resin binders, include Xerox 10, Xerox 22, Xerox 813, Xerox 914, Xerox 1824, Xerox 2400, AMI, Covex, 3M Imaging Powder, Konifax N-P, Konifax P-P, Excello, Tribofax, Lorivan, Pram, Labelon, Hunt Star Print, Copyflo PN-1, Van Dyk Gold Seal, IBM-5, and IBM-10. Reduction in toner filming may be obtained in each case.

While the invention has been shown and described with reference to preferred embodiments thereof, it will be appreciated by those skilled in the art that many variations in form may be made therein without departing from the spirit or scope of the invention.

What is claimed is:

1. In an electrophotographic process wherein an electrostatic image is made visible by contacting the surface bearing said image with a developer comprising finely divided toner particles of thermoplastic resin binder containing coloring pigment, the improvement according to which toner filming of the image bearing surface is reduced by incorporating in the developer in an amount up to 10% by weight of the toner and in particle size smaller than the toner, a particulate pigment-free organic polymer additive selected from the group consisting of polytetrafluoroethylene, polyvinylfluoride, polyvinylidenefluoride, polyethylene, polyhexafluoropropylene, copolymers of tetrafluoroethylene with tetrafluoropropylene, and copolymers of tetrafluoroethylene with hexafluoropropylene.

2. A process as claimed in claim 1 wherein the polymer additive is a tetrafluoroethylene-hexafluoropropylene copolymer.

3. A process as claimed in claim 1 wherein the polymer additive is polyethylene.

4. A process as claimed in claim 1 wherein the polymer additive is polyhexafluoropropylene.

5. A process as claimed in claim 1 wherein the polymer additive is polytetrafluoroethylene.

6. A process as claimed in claim 1 wherein the polymer additive particles have diameters of less than one micron.

7. A process as claimed in claim 1 wherein said toner and said polymer additive are freely movable in relation to each other.

8. A process as claimed in claim 1 wherein the polymer additive is polyvinylidenefluoride.

9. A dry developer composition for electrophotography comprising a toner of finely divided particles of resin and particles of an additive in an amount up to about 10% by weight of said toner, of a synthetic resin other than the resin of said toner, said particles of additive having an average size smaller than that of said toner particles, said particles of additive being at least one pigment-free synthetic resin selected from the group consisting of polyvinylidene fluoride, polytetrafluoroethylene, polyvinyl fluoride, polyethylene, polyhexafluoropropylene, poly(tetrafluoroethylene-tetrafluoropropylene) and poly(tetrafluoroethylene-hexafluoropropylene).

10. A dry developer composition for electrophotography comprising a toner of finely divided particles of thermoplastic resin and discrete particles of an additive, the additive being in an amount of up to 10% by weight of said toner and in particle size smaller than said toner, said additive being a pigment-free synthetic resin selected from the group consisting of polytetrafluoroethylene, polyvinylfluoride, polyvinylidenefluoride, polyethylene, polyhexafluoropropylene, copolymers of tetrafluoroethylene with tetrafluoropropylene, and copolymers of tetrafluoroethylene with hexafluoropropylene.

11. A composition as claimed in claim 10 wherein the additive is polytetrafluoroethylene.

12. The composition as claimed in claim 10 wherein the additive is polyvinylidenefluoride.

13. The composition as claimed in claim 10 wherein the additive is polyethylene.

14. A composition as claimed in claim 10 wherein the additive is polyhexafluoropropylene.

15. A composition as claimed in claim 10 wherein the additive is a copolymer of tetrafluoroethylene and hexafluoropropylene.

* * * * *